US012091221B2

(12) United States Patent
Gasbarro et al.

(10) Patent No.: US 12,091,221 B2
(45) Date of Patent: Sep. 17, 2024

(54) STORAGE CONTAINER WITH HINGED LID

(71) Applicant: F & M Tool & Plastics, Inc., Leominster, MA (US)

(72) Inventors: Mark A. Gasbarro, Leominster, MA (US); Marie-Eve Quimper, Boston, MA (US)

(73) Assignee: F & M TOOL & PLASTICS, INC., Leominster, MA (US)

( * ) Notice: Subject to any disclaimer, the term of this patent is extended or adjusted under 35 U.S.C. 154(b) by 0 days.

(21) Appl. No.: 17/872,381

(22) Filed: Jul. 25, 2022

(65) Prior Publication Data

US 2023/0025060 A1 Jan. 26, 2023

Related U.S. Application Data

(60) Provisional application No. 63/225,679, filed on Jul. 26, 2021.

(51) Int. Cl.
*B65D 43/16* (2006.01)
*B65D 43/22* (2006.01)

(52) U.S. Cl.
CPC ..... *B65D 43/161* (2013.01); *B65D 43/22* (2013.01); *B65D 2543/00194* (2013.01); *B65D 2543/00296* (2013.01); *B65D 2543/00527* (2013.01); *B65D 2543/00537* (2013.01); *B65D 2543/00648* (2013.01); *B65D 2543/00685* (2013.01); *B65D 2543/00759* (2013.01); *B65D 2543/00796* (2013.01)

(58) Field of Classification Search
CPC ..... B65D 43/161; B65D 43/22; B65D 45/16; B65D 45/20
See application file for complete search history.

(56) References Cited

U.S. PATENT DOCUMENTS

2006/0249522 A1* 11/2006 Ringo ..... B65D 45/20 220/784
2008/0083768 A1* 4/2008 Luburic ..... B65D 47/0847 220/810
2020/0198849 A1* 6/2020 Chen ..... B65D 85/24

* cited by examiner

*Primary Examiner* — Jeffrey R Allen
(74) *Attorney, Agent, or Firm* — Onello & Mello, LLP

(57) ABSTRACT

A plastic container comprises a container body having an opening to an interior of the container body; and a lid constructed and arranged for removably coupling to the container body The lid comprises a base portion covering a first region of the opening of the container body; a movable portion covering a second region of the opening of the container body in a closed position and exposing the opening to the interior of the container body in an open position; and a hinge arrangement between the base portion and the movable portion. The movable portion is constructed and arranged to rotate about an axis along which the hinge arrangement extends, and relative to the base portion. The base portion and the movable portion each extends at a predetermined height above the opening of the container body.

12 Claims, 15 Drawing Sheets

STORAGE CONTAINER WITH HINGED LID

RELATED APPLICATIONS

This application claims the benefit of U.S. Provisional Patent Application No. 63/225,679 filed on Jul. 26, 2021 entitled "Storage Container with Hinged Lid," the contents of which are incorporated herein by reference in its entirety.

TECHNICAL FIELD

The present inventive concepts generally relate to the field of storage containers, and more particularly, to storage containers having a raised hinged lid.

BACKGROUND

Conventional storage containers are offered in various shapes and sizes, and typically formed of plastic. A plastic container typically includes a lid that covers the opening of the container to protect its contents.

SUMMARY

Embodiments of the present inventive concepts are directed to storage containers that include a lid that increases the interior dimensions of the storage containers.

In one aspect, provided is a plastic container, comprising: a container body having an opening to an interior of the container body; and a lid constructed and arranged for removably coupling to the container body, the lid comprising: a base portion covering a first region of the opening of the container body; a movable portion covering a second region of the opening of the container body in a closed position and exposing the opening to the interior of the container body in an open position; and a hinge arrangement between the base portion and the movable portion, wherein the movable portion is constructed and arranged to rotate about an axis along which the hinge arrangement extends, and relative to the base portion, wherein the base portion and the movable portion each extends at a predetermined height above the opening of the container body to increase a volume of an interior of the container to be greater than the interior of the container body.

In another aspect, provided is a plastic lid constructed and arranged for removably coupling to a container body, the plastic lid comprising: a base portion covering a first region of the opening of the container body; a movable portion covering a second region of the opening of the container body in a closed position and exposing the opening to the interior of the container body in an open position; and perimeter skirt constructed and arranged to form a seal with a rim of the container body, wherein the base portion and the movable portion each extends at a predetermined height above the opening of the container body to increase a volume of an interior of the container to be greater than the interior of the container body.

BRIEF DESCRIPTION OF THE DRAWINGS

The foregoing and other objects, features and advantages of embodiments of the present inventive concepts will be apparent from the more particular description of preferred embodiments, as illustrated in the accompanying drawings in which like reference characters refer to the same elements throughout the different views. The drawings are not necessarily to scale, emphasis instead being placed upon illustrating the principles of the preferred embodiments.

DETAILED DESCRIPTION OF EMBODIMENTS

Figure 1A:
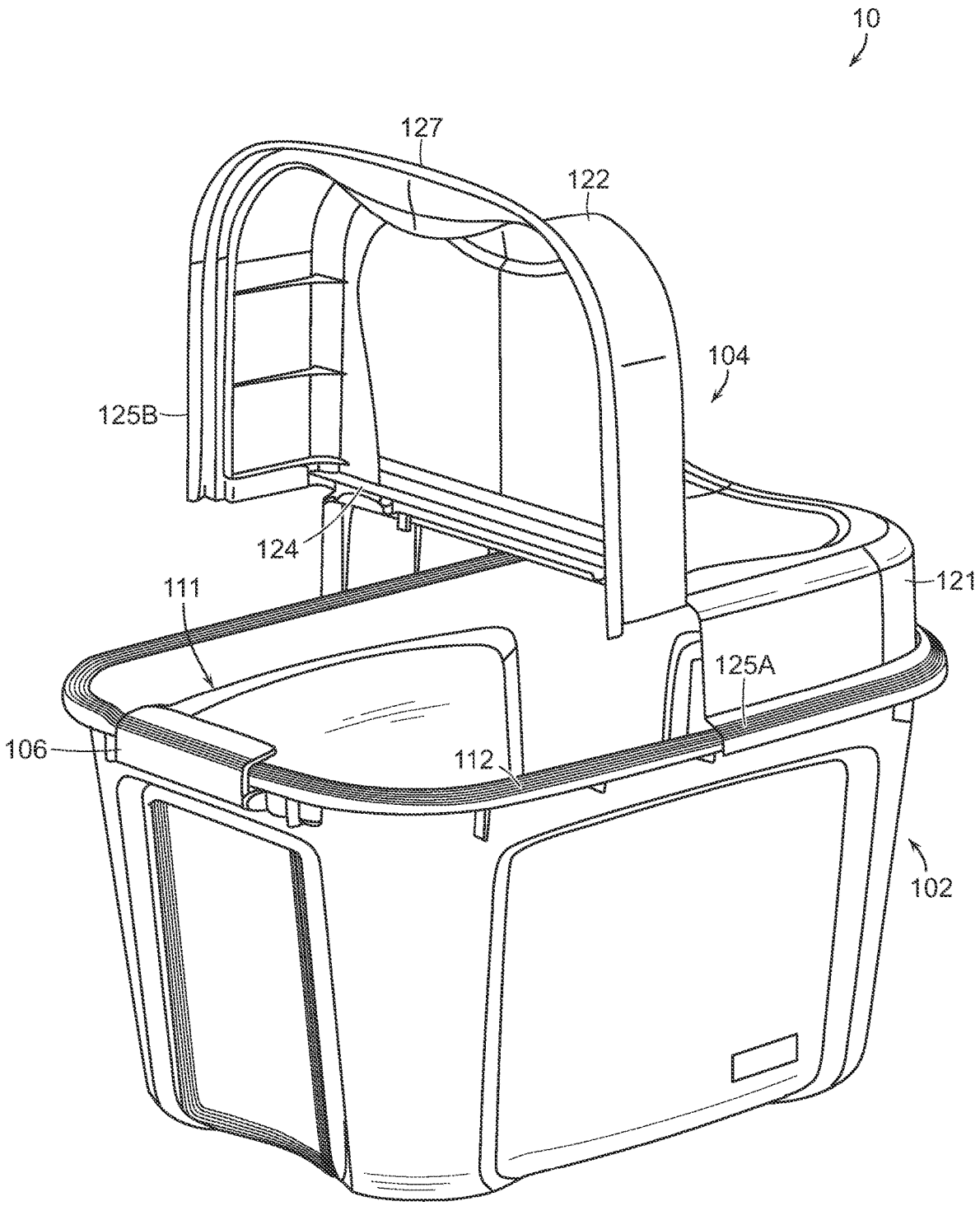
FIG. 1A is a perspective view of a raised hinge lid storage container in an open state, in accordance with embodiments of the present inventive concept.

The terminology used herein is for the purpose of describing particular embodiments and is not intended to be limiting of the inventive concepts. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

It will be understood that, although the terms first, second, third etc. may be used herein to describe various limitations, elements, components, regions, layers and/or sections, these limitations, elements, components, regions, layers and/or sections should not be limited by these terms. These terms are only used to distinguish one limitation, element, component, region, layer or section from another limitation, element, component, region, layer or section. Thus, a first limitation, element, component, region, layer or section discussed below could be termed a second limitation, element, component, region, layer or section without departing from the teachings of the present application.

It will be further understood that when an element is referred to as being "on" or "connected" or "coupled" to another element, it can be directly on or above, or connected or coupled to, the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.). When an element is referred to herein as being "over" another element, it can be over or under the other element, and either directly coupled to the other element, or intervening elements may be present, or the elements may be spaced apart by a void or gap.

Although plastic containers are prevalent in the home or office, modern consumers want containers to require as little room as possible while providing a maximum storage capacity. Containers can be offered in various shapes and sizes to provide a desired volume. For example, one container body may have a length, width, and height that provides for a 1 quart interior, while the dimensions of another container body to provide for a 10 gallon interior volume.

In brief overview, embodiments of the present inventive concepts provide a hinged lid storage container where the lid when attached to and sealed about the container body can increase the capacity of a container body by up to 20%, or more. In addition, the hinged lid is constructed and arranged to allow customers to open the lid and install or remove goods through an opening in the lid to the interior of the container by only releasing one handle, which opens the lid at the top of the container. Accordingly, the lid can contribute additional volume to the container, allowing for more storage while also offering easy access to the contents inside the container.

Figure 1B:
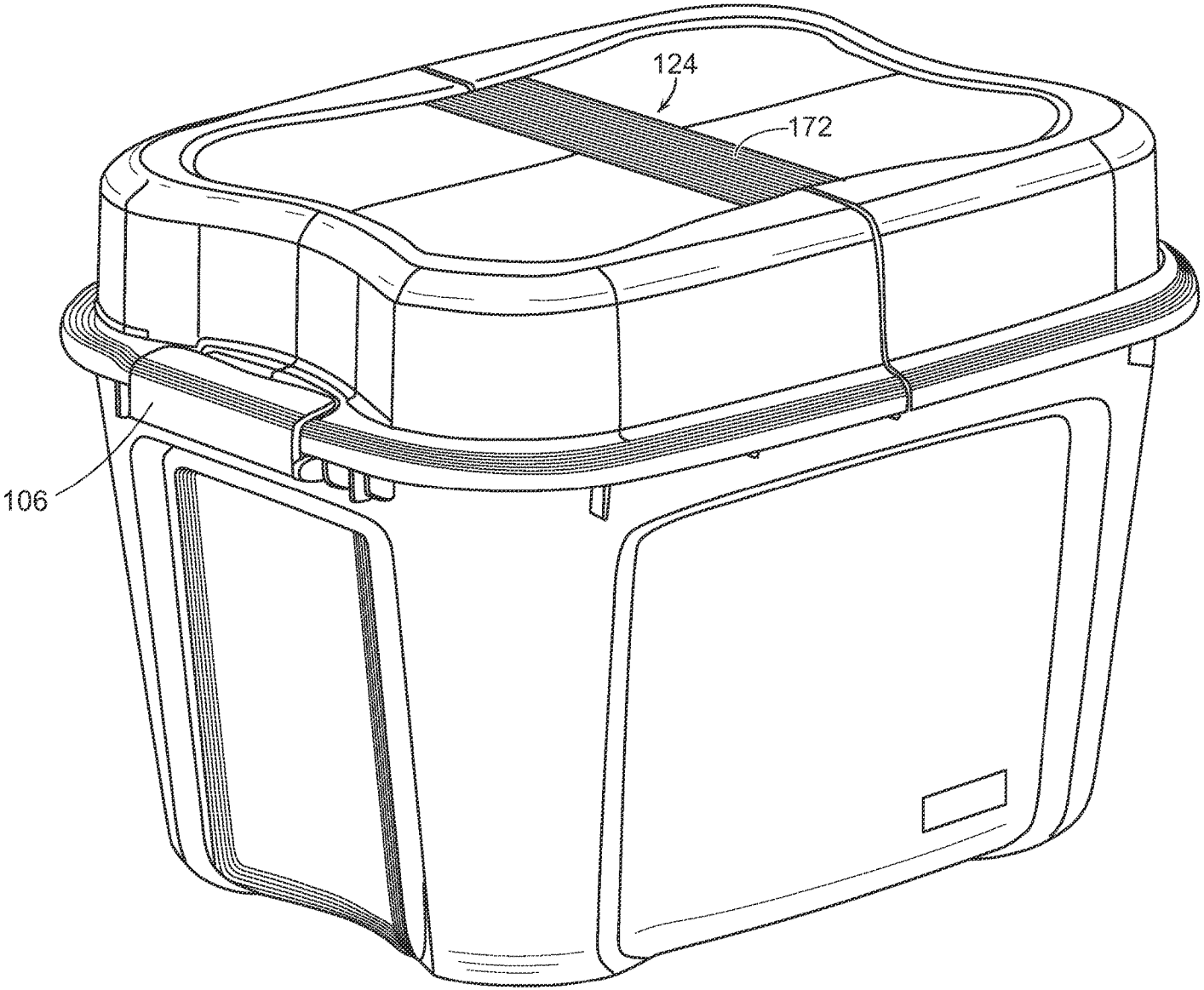
FIG. 1B is a perspective view of the raised hinge lid storage container of FIG. 1A in a closed state.
Figure 2:
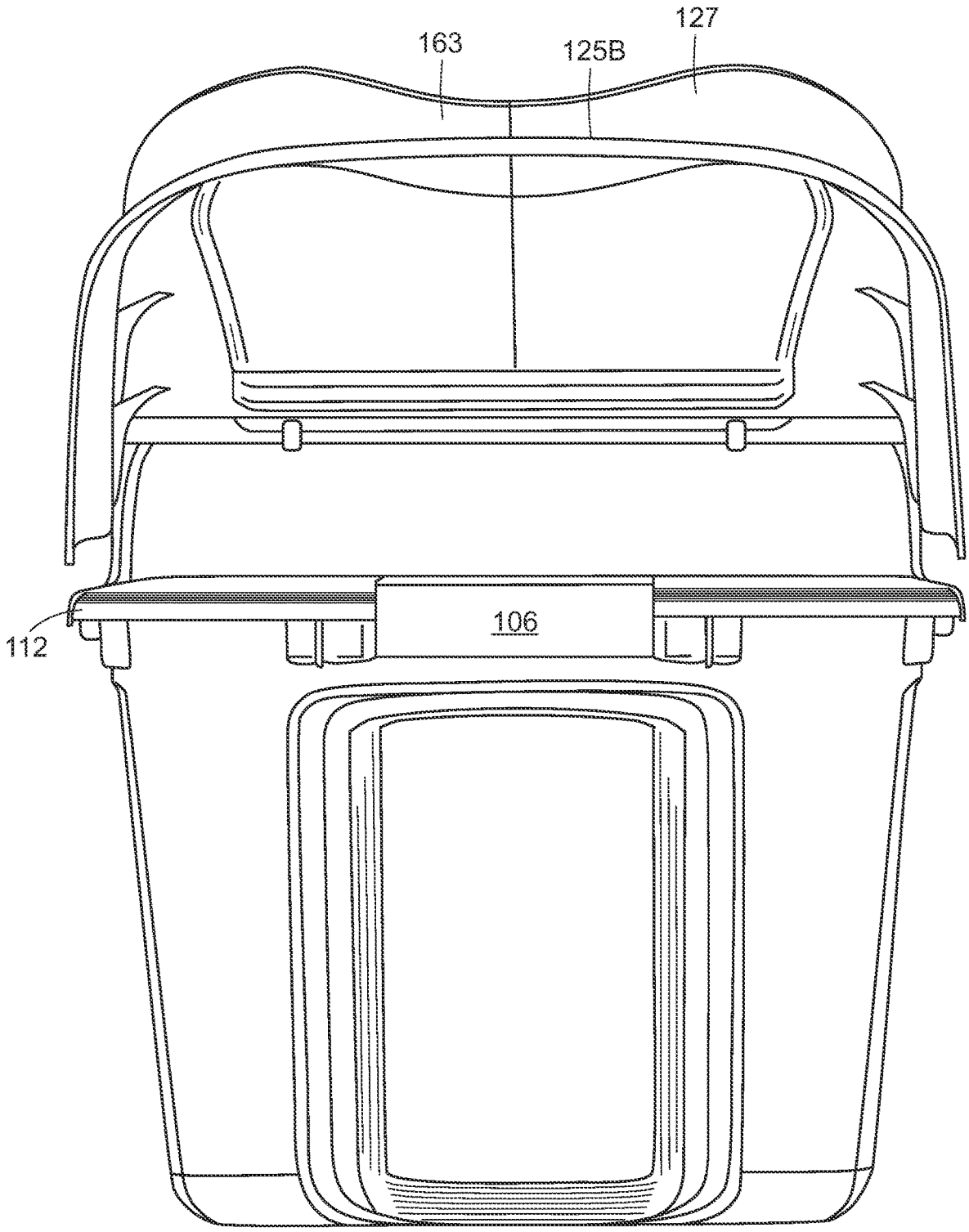
FIG. 2 is front view of the raised hinge lid storage container of FIGS. 1A and 1B.
Figure 3:
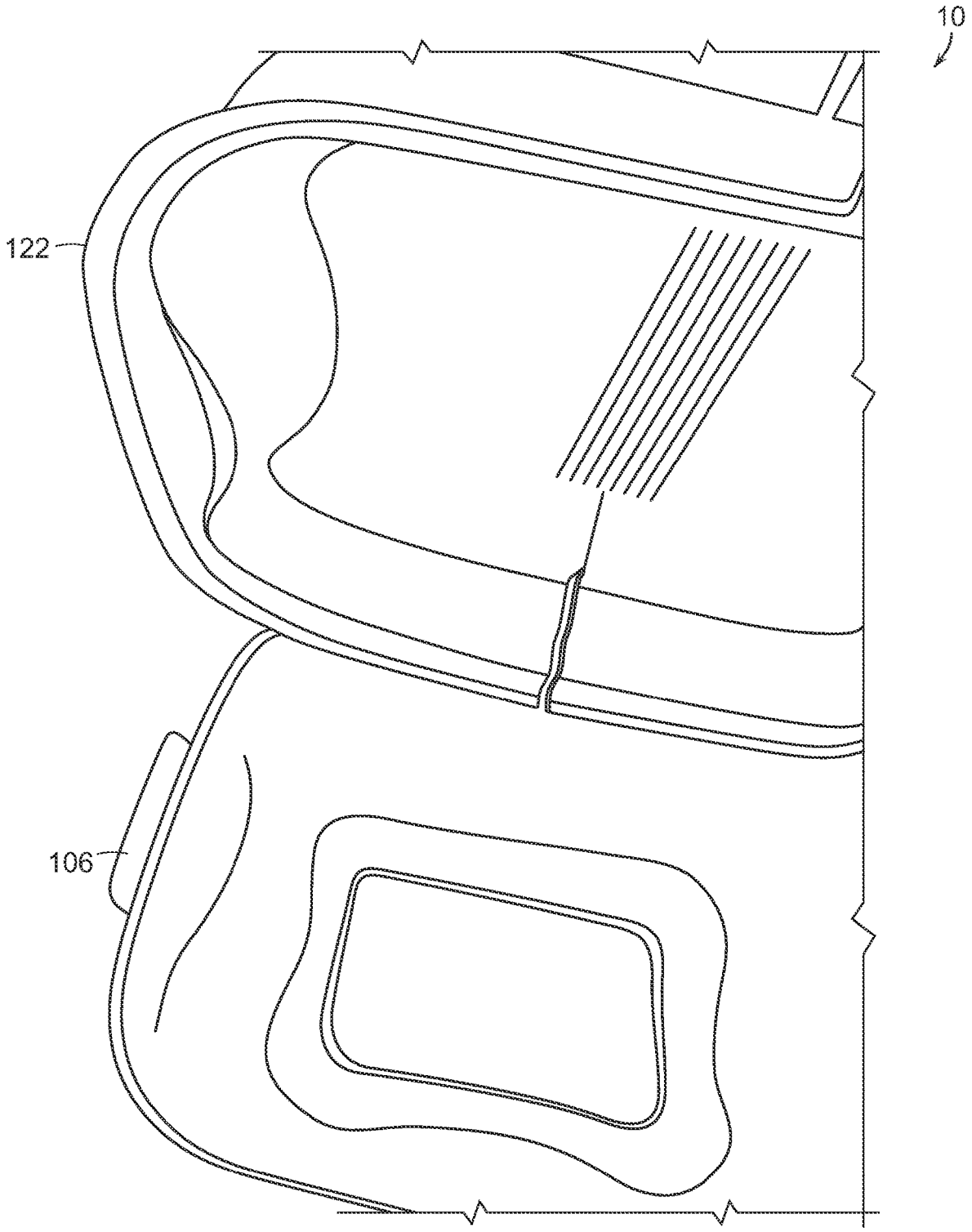
FIG. 3 a perspective view of the raised hinge lid storage container where the lid is separate from the container body, in accordance with some embodiments.

As shown in FIGS. 1A and 1B, a storage container 10 can include a container body 102 and a lid 104. The storage container 10 may have different configurations and storage capabilities constructed and arranged in accordance with embodiments of the present inventive concepts. The storage container 10 can provide a range of functions, such as storing food, items, and so on, shipping such items to other locations, and so on.

The container body 102 and/or lid 104 can be formed, for example, molded, of plastic or other rigid polymer material. The material(s) forming the container body 102 and lid 104 can be the same or different. The container body 102 and lid 104 can be formed together, for example, a common mold, or formed separately and coupled together after independent formations. As shown, a container body 102 and/or lid 104 can have a square or rectangular shape with rounded corners or edges, but not limited thereto. For example, the container body 102 may have a cylindrical shape. However, other shapes and configurations of the body and lid are intended to fall within the scope of the invention. The invention is not to be limited to a specific container base and lid perimeter shape or overall contour.

The container body 102 is constructed to have an interior surface area, volume, length, width, height, and/or other dimensions to provide a desired interior capacity for storing various objects of interest, such as food, toys, clothing, books, personal items, and so on.

The lid 104 is constructed and arranged to close off or seal some or all of the open top 111 of the container body 102 by connecting a part of the perimeter skirt 125 of the lid 104 to an annular flange or rim 112 extending from a top portion of the body 102 forming the opening 111 to the interior of the container body 102. In some embodiments, the container lid 104 is constructed and arranged to include features that allow it to cover and seal the open top 111 of the container body 102. In particular, the annular flange or rim 112 extends radially outwardly from and circumferentially around the top edge of the container body 102. The rim 112 may be curved so that the outermost edge of the rim extends in vertical or near vertical direction, for example, in a same parallel direction as an outermost edge of the perimeter skirt 125 of the lid. In some embodiments, the outermost edge of the rim 112 is flush with the outermost edge of the perimeter skirt 125 of the lid when the lid 104 is positioned on the container body 102, as shown by region R. In some embodiments, the rim 112 extends from a side wall, but spaced below the top edge. When the lid 104 is positioned over the top region of the container body, the lid 104 attached to the body 102 can form an interface with an upper lip at the top of the container body 102, in particular, due the perimeter skirt 125 constructed and arranged for positioning over and directly communicating with, e.g., coupling, the rim 112.

In some embodiments, the container lid 104 comprises a base portion 121, a movable portion 122, a hinge arrangement 124 coupled between the base portion 121 and movable portion 122, a first lip 125A and a second lip 125B, also collectively forming a perimeter skirt 125. In some embodiments, the movable portion 122 has a front region 127 opposite a rear region forming and/or coupling with the hinge arrangement 124 that is constructed and arranged to engage with a locking clip 106 coupled to, and positioned about the annular flange or rim 112 of the container body 102. This feature permits a user to insert contents into the container body 102 or remove contents from the container body 104 by releasing one locking clip 106, which permits the hinged lid 122 to open by rotating about an axis formed by the hinge assembly 124 and expose the interior of the container body 102. The other locking clamp 106 on the opposite end of the container remains in a closed position to hold the base portion 121 of the lid 104 in place against the container body 102. As shown in FIG. 1B, the two locking clips 106 can function as handles when in the locked position.

Figure 4A:
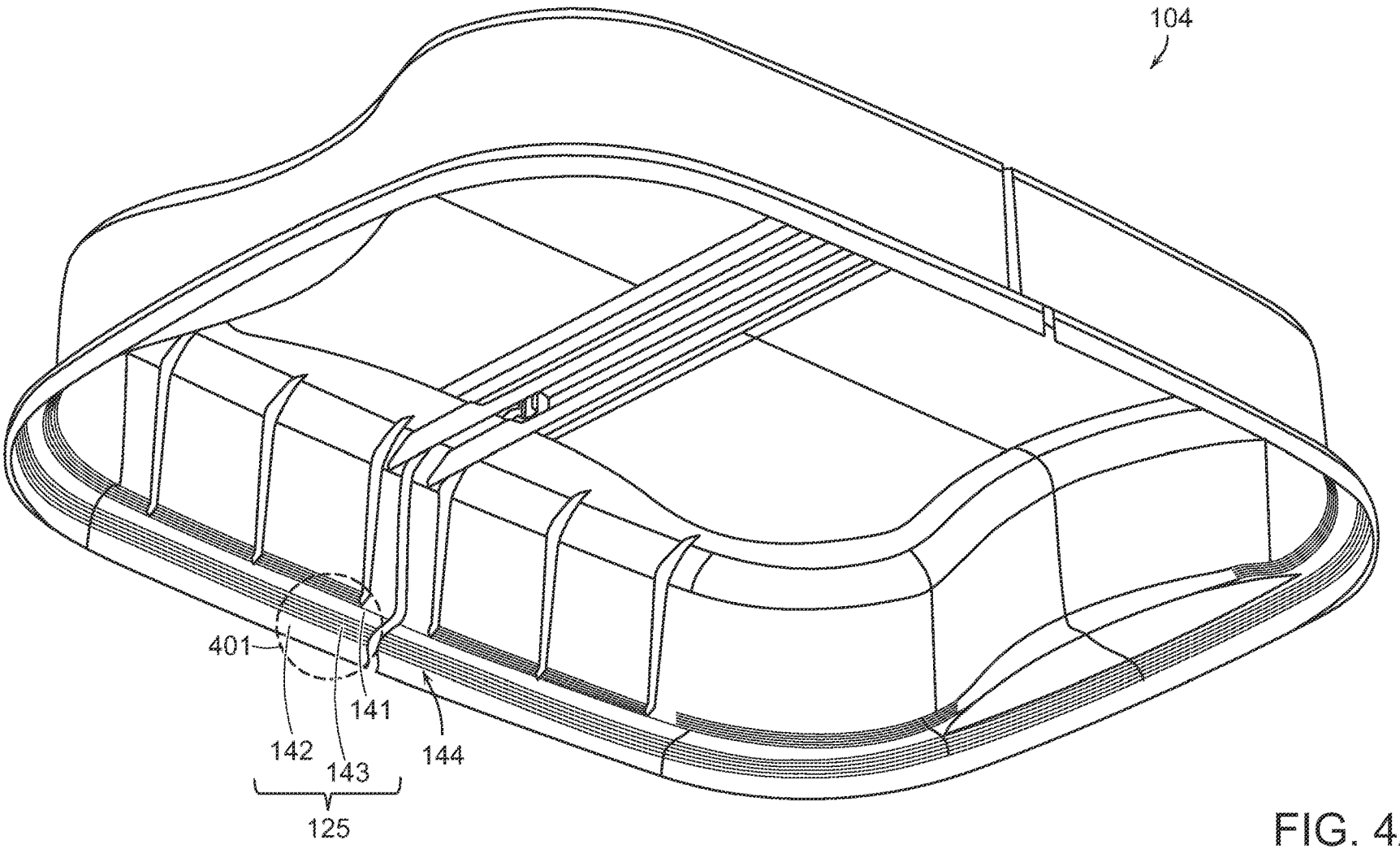
FIG. 4A is a close-up perspective view of a storage container lid, in accordance with embodiments of the present inventive concept.
Figure 4B:
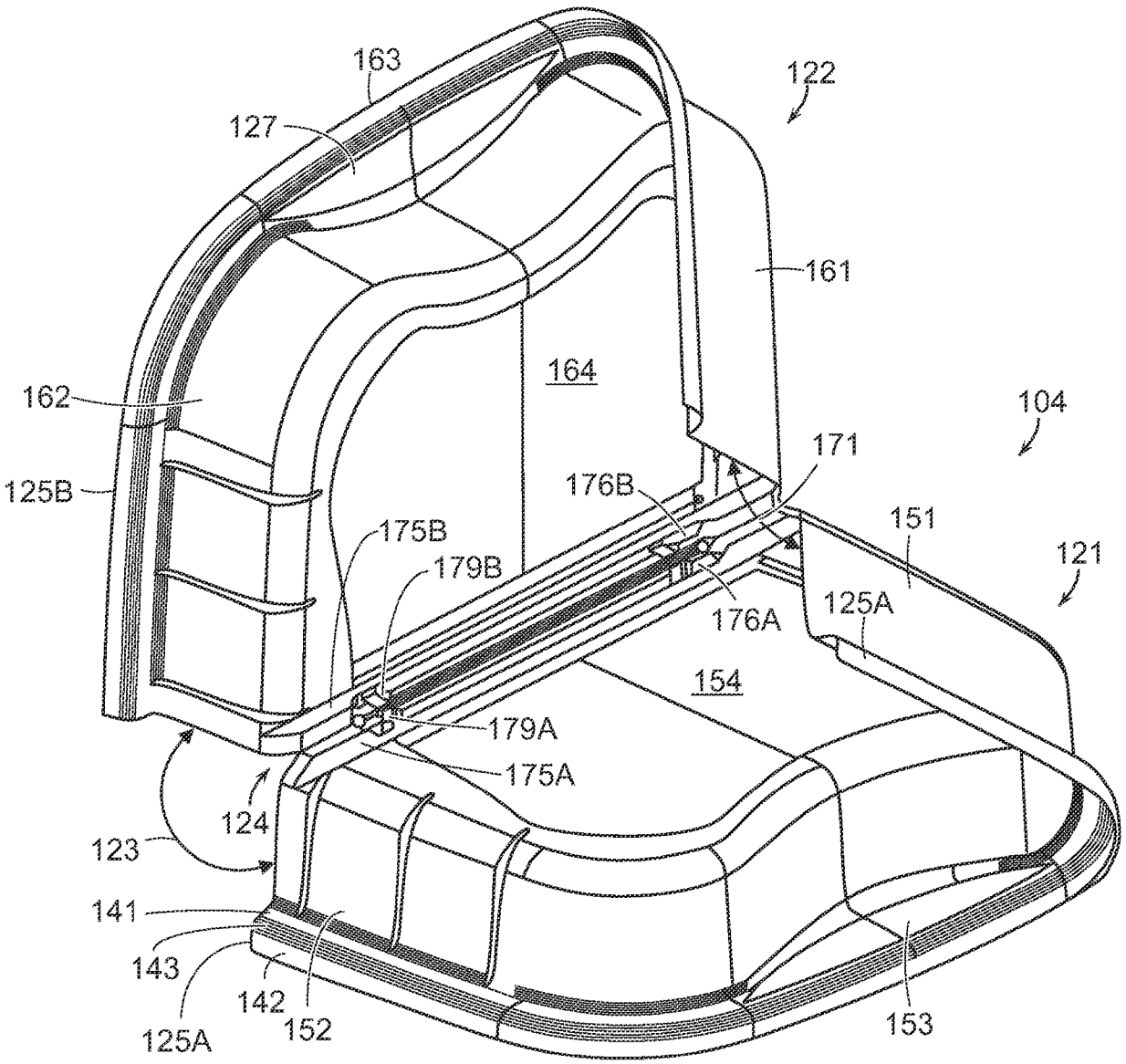
FIG. 4B is a perspective view of the storage container lid of FIG. 4A in a closed state.

As shown in FIGS. 4A and 4B, the base portion 121 of the lid 104 has a first sidewall 151, a second sidewall 152, and a rear sidewall 153 extending between the first sidewall 151 and the second sidewall 152. Each sidewall 151-153 extends from a top surface 154. The sidewalls 151-153 may be perpendicular to the top surface 154, or may be tapered, e.g., extending at an obtuse angle to increase the area inside the interior or the lid 104 as the sidewalls 153 extend from the top surface 154. Here, the top surface 154 may have a perimeter, surface area, and/or other dimension that is less than that at the top region of the container body 102, e.g., the area formed by the annular flange or rim 112.

The movable portion 122 of the lid 104 has a first sidewall 161, a second sidewall 162, and a front sidewall 163 extending between the first sidewall 161 and the second sidewall 162. A portion of the front sidewall 163 includes the front region 127, which has a shape, configuration or the like for engaging with the locking clip 106. The sidewalls 161-163 may be perpendicular to the top surface 164, or may be tapered, similar to sidewalls 151-153, and contribute additional volume to the container body 102, while also offering easy access to the interior of the container body 102 via the movable portion 122 in an open position. The lid 104 is therefore secured to the container body 102 so that items can be placed in the container to a height that extends vertically beyond the rim 112 of the container body 102 because of the extra height and volume offered by the lid 104. For example, the sidewalls 152, 162 of the lid can form an interior surface area such that the lid when coupled to the container body 102 provides a volume, i.e., combination of interior of container body 102 and lid 104 that is greater than an interior volume of the container body alone. In some embodiments, this increase can be up to 20%, or greater than 20%. The secure attachment of the lid 104 prevents the lid 104 from disengaging from the rim 112 of the container body 102 when filled with objects.

As previously described, the hinge arrangement 124 is coupled between the base portion 121 and movable portion 122, and is constructed and arranged so that the movable portion 122 rotates about an axis along which the hinge arrangement 124 extends, and relative to the base portion 121 which remains positioned over and coupled to the rim 112 of the container body 102 while the movable portion 122 rotates. In some embodiments, the movable portion 122 can rotate to a vertical position, e.g., 90 degrees relative to the base portion 121 in a horizontal position. In other embodiments, the movable portion 122 can rotate to a maximum angle so that the top surface 164 of the movable portion 122 is at an acute angle relative to the top surface 154 of the base portion 121, or the movable portion 122 can rotate about an axis along a width of the lid about which the hinge arrangement 124 extends until the top surface 164 and/or edge 165 is parallel to or directly abuts the top surface 154 and/or edge 155 of the base portion.

The skirt assemblies 125A, 125B (generally, 125) circumvents the perimeter, e.g., rim, of the lid and can have U-shape, V-shape, or other curved or flared contour that provides an opening for positioning over the rim 112 of the container body 102. For example, as shown in FIGS. 4A and 4B, the skirt assemblies 125 can have a first wall 141 the extends perpendicular or near perpendicular from a wall 151, 152, 153, 161, 162, 163 of the lid 104 to a curved, rounded, angled, or straight corner region 142 to a second wall 143 that is perpendicular or near perpendicular, or angled at an obtuse angle relative to the first wall 141, e.g., extending down in a vertical direction or angle relative to the first wall 141. A channel 144 can be formed from the first wall 141, corner region 142, and second wall 143 (collectively forming a skirt assembly 125), and the top perimeter of the container body 102 can fit in the channel 144, for example, shown at region 401.

Figure 5A:
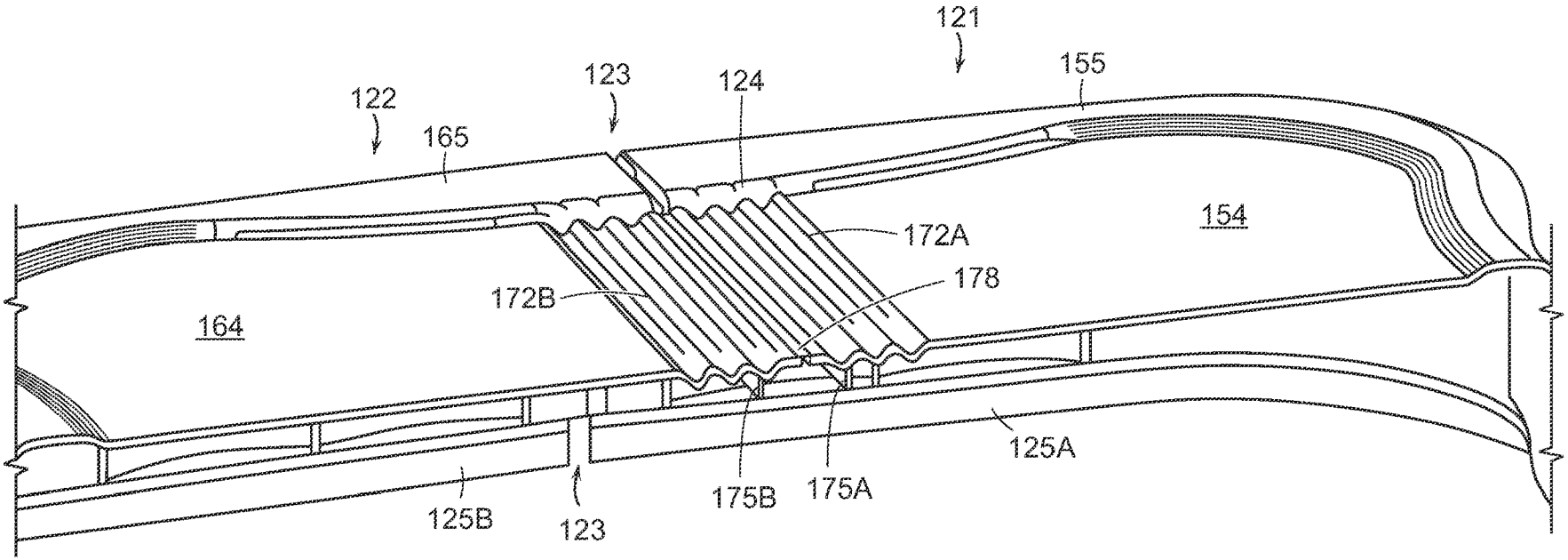
FIG. 5A is a close-up perspective view of a top surface of a hinge arrangement of a storage container lid, in accordance with embodiments of the present inventive concept.
Figure 5B:
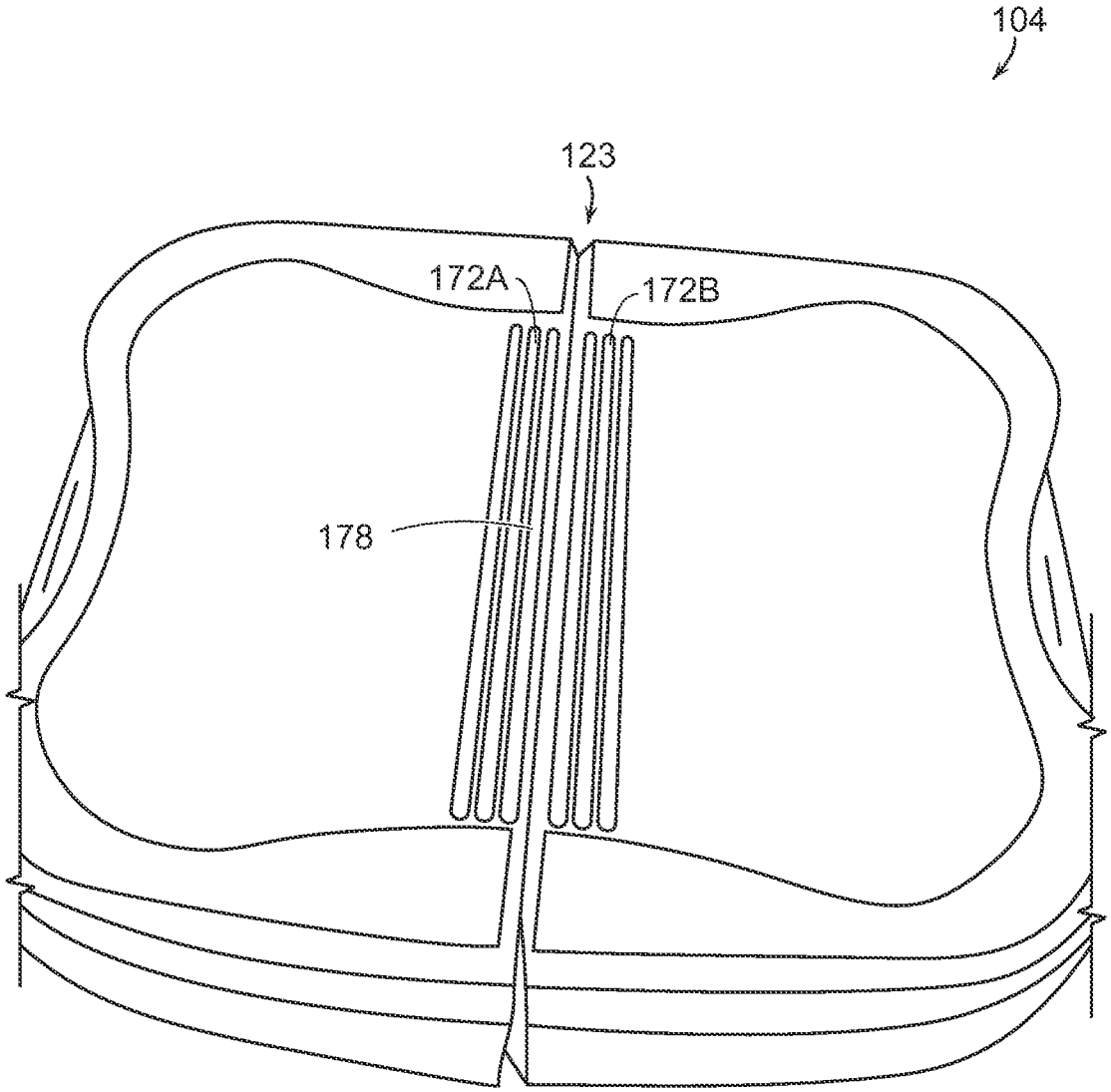
FIG. 5B is another close-up perspective view of the top surface of the hinge arrangement of a storage container lid.
Figure 5C:
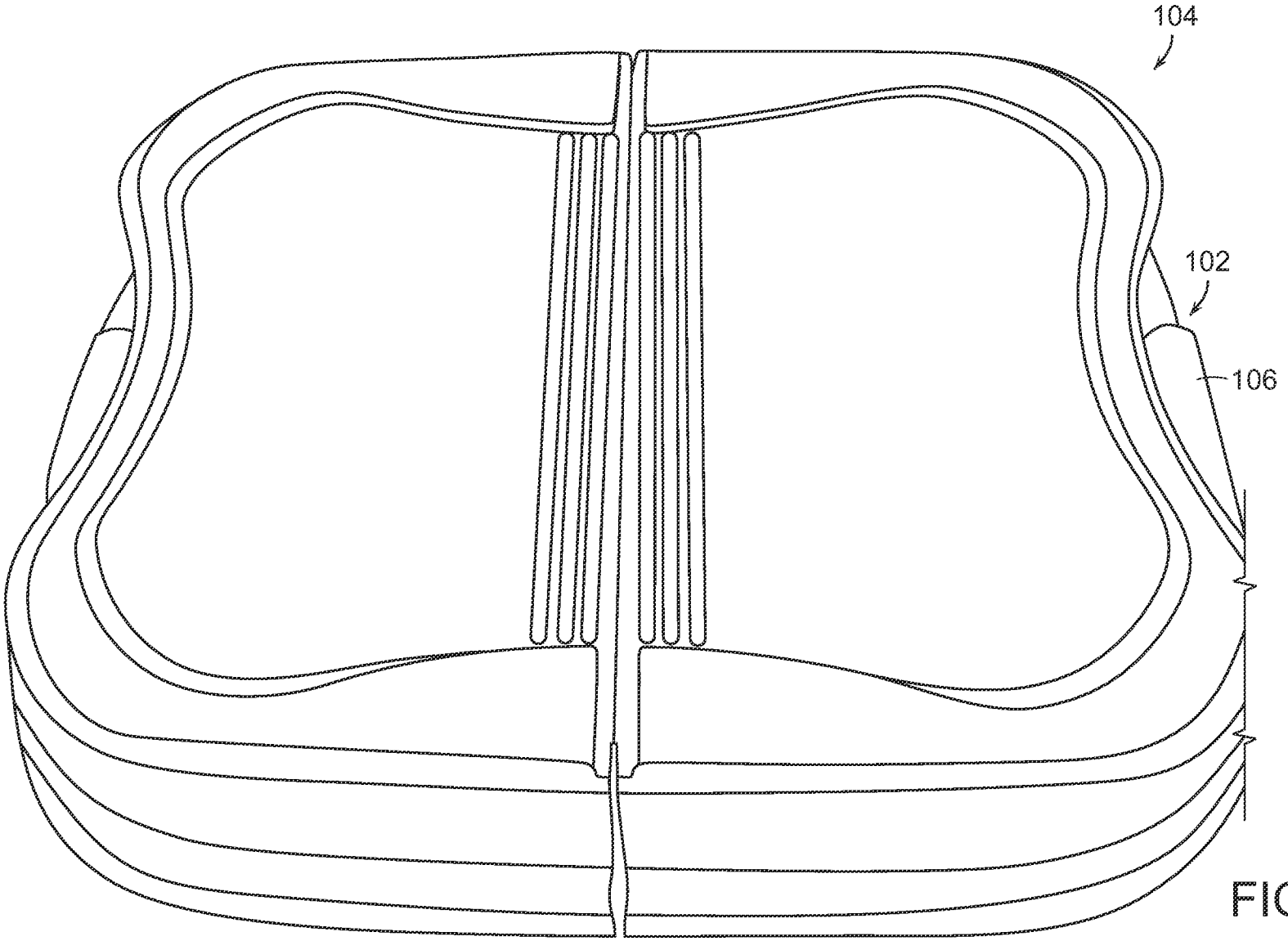
FIG. 5C is a top view of the storage container lid of FIGS. 5A and 5B coupled to a storage container with first and second locking clips, according to some embodiments.

In particular, FIG. 5 illustrates a top surface of the hinge arrangement 124, including a hinge unit 178 that connects a first plurality of ridges 172A and a second plurality of ridges 172B. The ridges 172A and 172B offer more strength and stability to the lid 102 because their shape and thickness function as supporting ribs extending along a width of the lid 102. The hinge unit 178 extends along a width of the lid 104 and has a thickness that it less than that of the ridges 172A or other region of the top surface 154 of the base portion 121 and also less than that of the ridges 172B of the top surface 164 of the movable portion 164. The smaller thickness of the hinge unit 178 allows the hinge assembly to bend about a bend axis along which the hinge unit extends, and thereby permits the movable portion 122 to open and close relative to the stationary portion 121 coupled to the container body 102. The hinge unit 178 provides adequate separation between the two portions 154, 164 of the lid when the hinge assembly 124 is bent. first and second portions of the housing when the housing is bent, and ensure that the lid 104 can maintain a desired minimum bend radius in the vicinity of the bend axis. In some embodiments, the hinge unit 178 separates the base portion 121 and movable portion 122 by a predetermined distance, and forms a gap 123 between an outer edge of the base portion 121 and an outer edge 165 of the movable portion 122 along a same plane as the outer edge 155 of the base portion 121 in a closed position. The gap 123 allows the movable portion 122 to transition between the closed position and an open position, which can allow the movable portion 122 to rotate about an axis along which the hinge unit 178 extends, up to 180 degrees until the top surface 164 or neighboring edge 165 abuts the top surface 154 or edge 155 of the base portion 121. As shown in FIG. 5B, the gaps 123 on both sides of the lid 104 extends horizontally to the two ends of the hinge unit 178. Accordingly, the ridges 172A of the base portion 121 are pivotably stationary or fixed, while the ridges 172B of the movable lid portion 121 pivotably rotates about an axis along which the hinge unit 178 extends.

Figure 6:
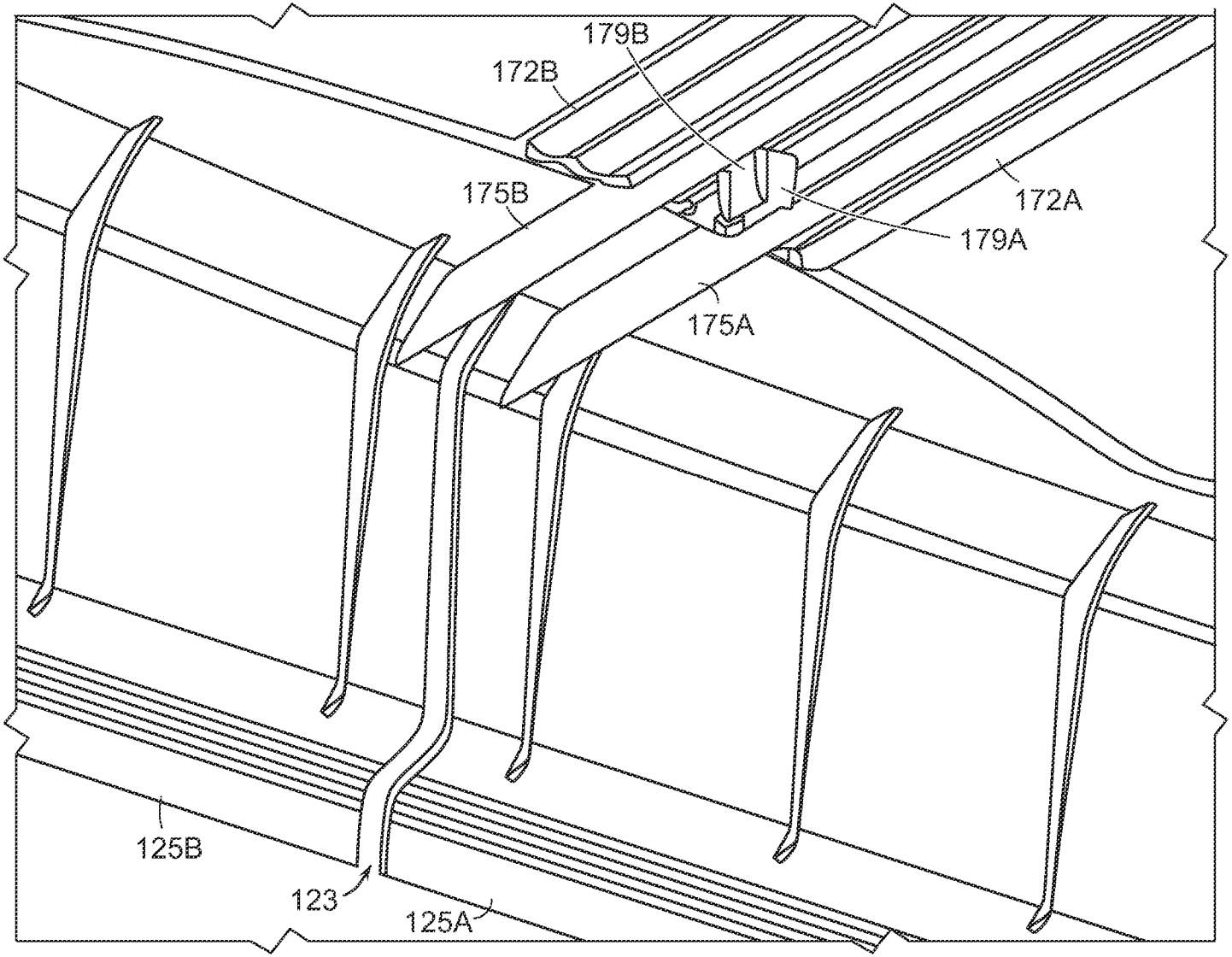
FIG. 6 is a close-up perspective view of an underside of the hinge arrangement of FIG. 5, according to some embodiments.

FIG. 6 is a close-up perspective view of an underside of the hinge arrangement 124 of FIG. 5, according to some embodiments. A pair of stabilizing bars 175A, 175B, also referred to as ribs or elongated features extending from the underside of the stationary 121 and movable 122 portions of the lid respectively, are parallel to the ridges 172, 172B and extend along a width of the lid 104. One bar 175A is part of the stationary portion 121 and the other bar 175A is part of the movable portion 122. A pair of tabs 179A, 179B are likewise part of the stationary portion 121 and movable portion 122, respectively, and extend vertically between the stabilizing bars 175A, 175B to contribute to the reinforcement of the hinge unit 178 therebetween. The tabs 179A, 179B may be constructed and arranged to directly abut each other when the lid 104 is closed, i.e., when the movable portion 122 extends along a same plane as the stationary portion 121, and to maintain a gap 123 between the two portions 121, 122. In some cases, the gap 123 shown in FIG. 6 is reduced or closed, wherein the skirt assemblies 125A, 125B of the stationary 121 and movable portions 122 of the lid 104, respectively, abut each other or the gap 123 is otherwise reduced or minimized. In some embodiments, the tabs 179A, 179B do not touch and are separated by a predetermined distance when the when the movable portion 122 is in a closed position. As shown in FIG. 4B, a second pair of tabs 176A, 176B may be located at an opposite side of the lid 104 as the first set of tabs 179A, 179B, and can operate in a similar manner as the first tabs 179A, 179B. In some embodiments, one or more ribs, hooks, or other coupling devices extend from the skirt assembly 125A and/or skirt assembly 125B, and/or one or more sidewalls 151-153, 161-163 to form a lip or the like for removably attaching to the rim 112 of the container body 102, in addition to or instead of the locking clips 106 of the container body 102 removably coupling to the from the skirt assembly 125A and skirt assembly 125B.

Figure 7:
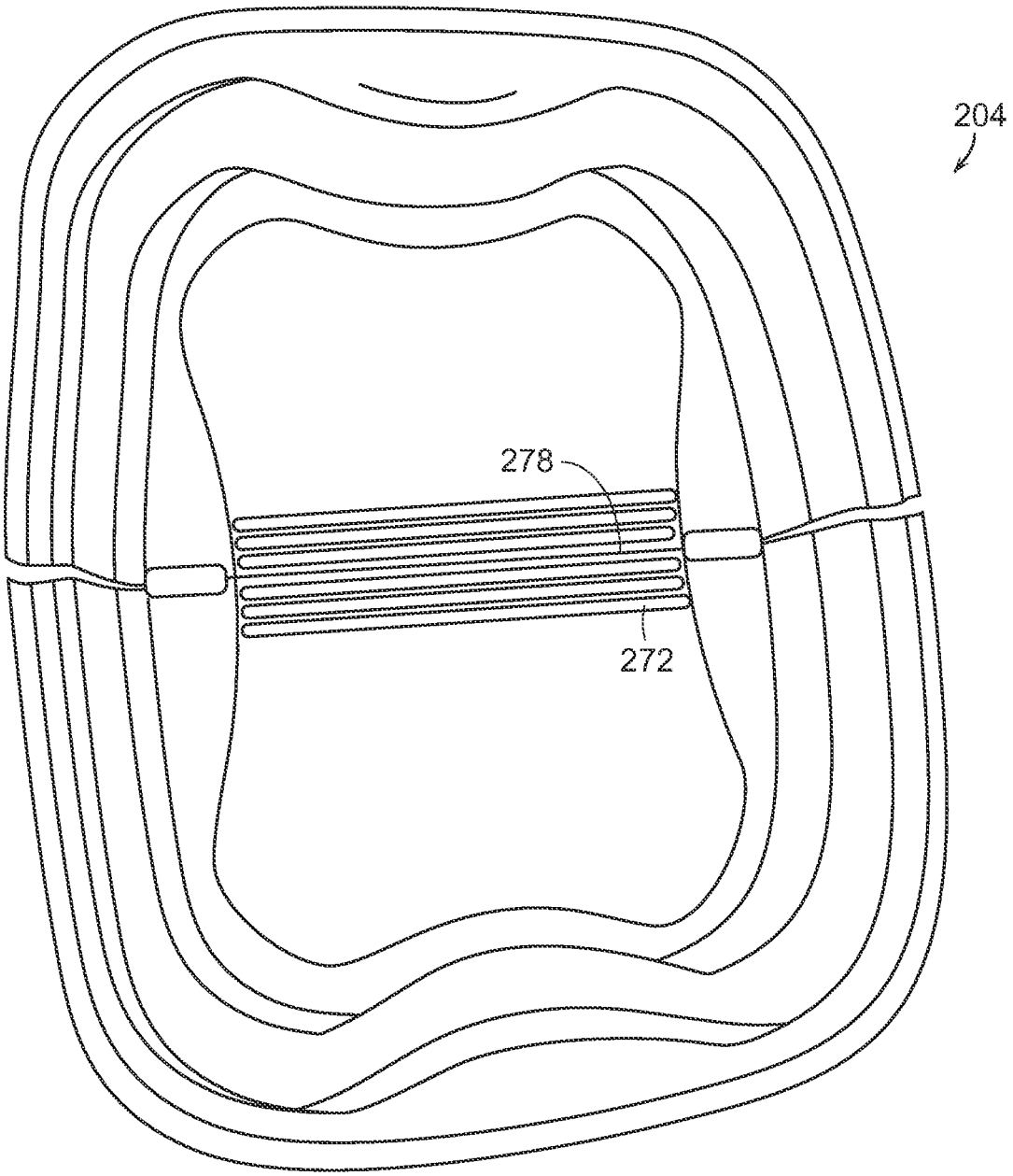
FIG. 7 is a close-up perspective view of an underside of the hinge arrangement of FIG. 5, according to other embodiments.

As shown in FIG. 7, other embodiments of a storage container lid 200 can include ridges 272A, 272B (generally, 272) and hinge unit 278 similar to FIGS. 1-6, but may not include the tabs 179A, 179B and stabilizing bars 175A, 175B. Instead, the ridges 272 and hinge unit 278 are constructed to permit the lid 200 to be securely coupled to the container body 102 with stability while enjoying sufficient rigidity to allow either portion 221 or 222 to function as a base portion similar to base portion 121 of FIGS. 1A-6 while the other portion functions as a movable portion similar to movable portion 122 of FIGS. 1A-6. For example, a first locking clip 106 in a locked position can be coupled to the first portion 221 to latch the first portion 221 in place against the container body 102. A second locking clip 106 can be in an open position to allow the second portion 222 to rotate about an axis formed by the hinge arrangement extending along a width of the lid 200, similar to hinge arraignment 124 of FIGS. 1-6. In some embodiments, the first portion 221 and second portion 222 including their components are symmetric, as are the first and second locking clips 106. This is illustrated by example in FIGS. 9A and 9B.

Figure 8:
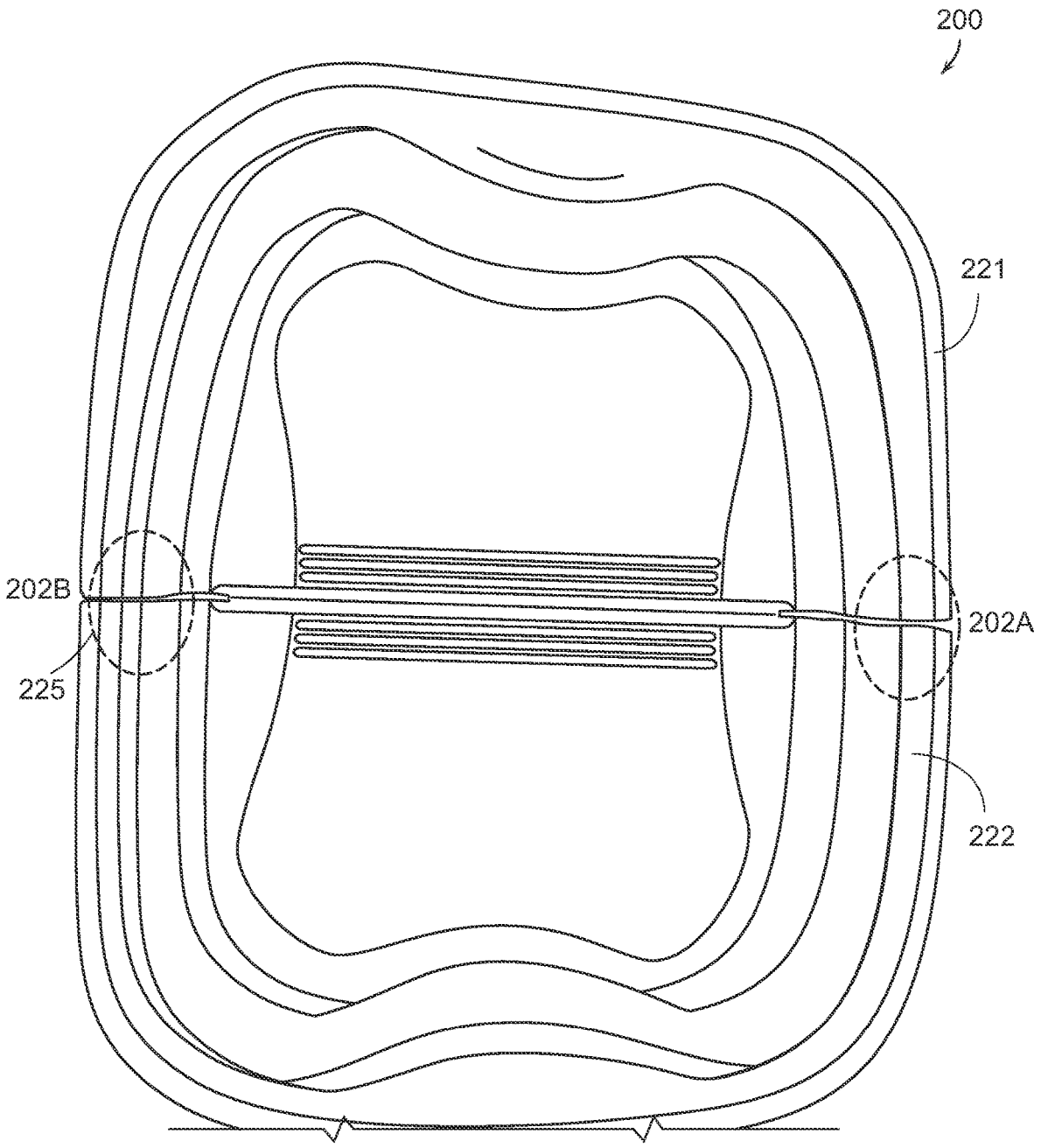
FIG. 8 is a perspective view of an underside of the hinge arrangement of the storage container lid of FIG. 7, according to other embodiments.

In some embodiments, the lid 200 includes one or more supporting elements 202, which may be constructed and arranged as ribs, tabs, or the like that extend in a vertical or orthogonal direction from a skirt assembly 225. The supporting elements 202 shown in FIGS. 8-9B have a shape that includes at least one tapered surface. However, other shapes may equally apply to perform the function of adding stability and security to the lid when coupled to the container body. In some embodiments, the supporting elements may include grooves, ridges, notches, or the like to catch a portion of the container body. The skirt assembly 225 may comprise regions and components similar to those illustrated in the skirt assembly 125 of FIGS. 4A and 4B, and are not repeated for brevity.

Figure 9A:
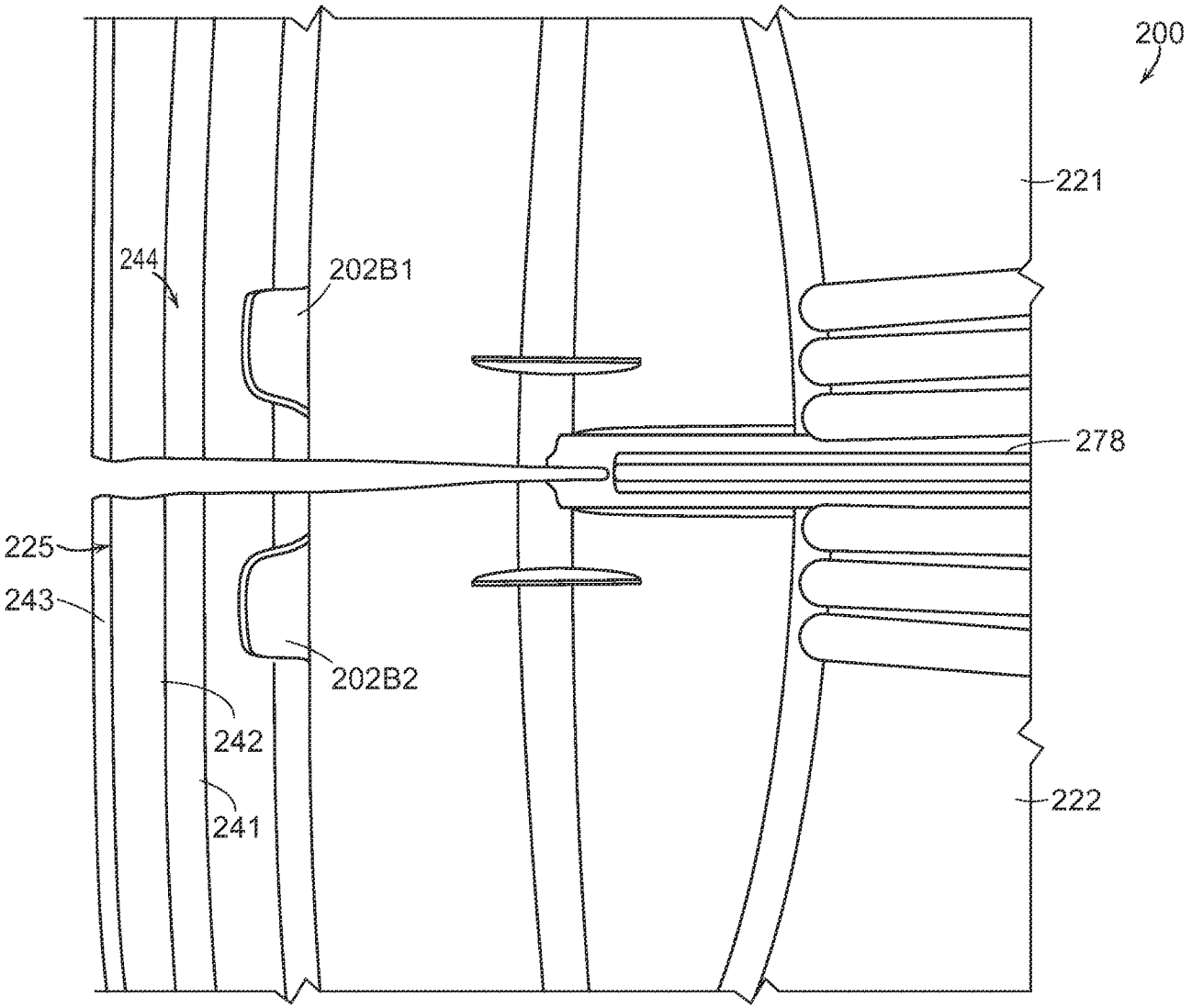
FIG. 9A is a close-up perspective view of a first side of the underside of the storage container lid of FIGS. 7-8.

For example, as shown in FIG. 9A, the skirt assembly 225 can have a first wall 241 the extends perpendicular or near perpendicular from the hinge arrangement 278 to a curved, rounded, angled, or straight corner region 242 to a second wall 243 that is perpendicular or near perpendicular, or orthogonal or angled at an obtuse angle relative to the first wall 241, e.g., extending down in a vertical direction or angle relative to the first wall 241. A channel 244 can be formed from the first wall 241, corner region 242, second wall 243, and supporting element 202. A top perimeter of the container body 102 can fit in the channel 244, for example, secured at least in part by the supporting element 244.

Figure 9B:
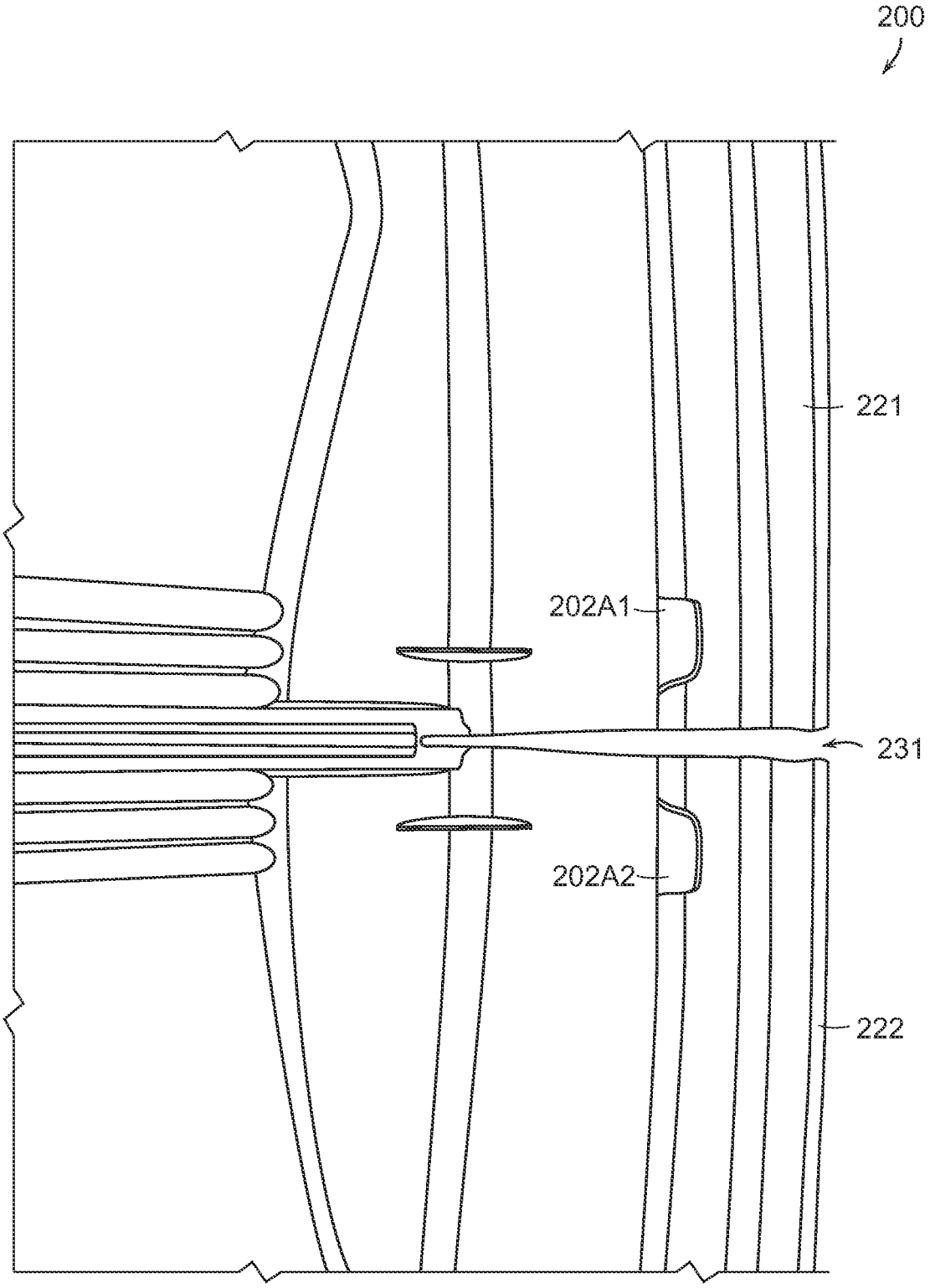
FIG. 9B is a close-up perspective view of a second side of the underside opposite the first side of the storage container lid of FIGS. 7-9A.
Figure 10:
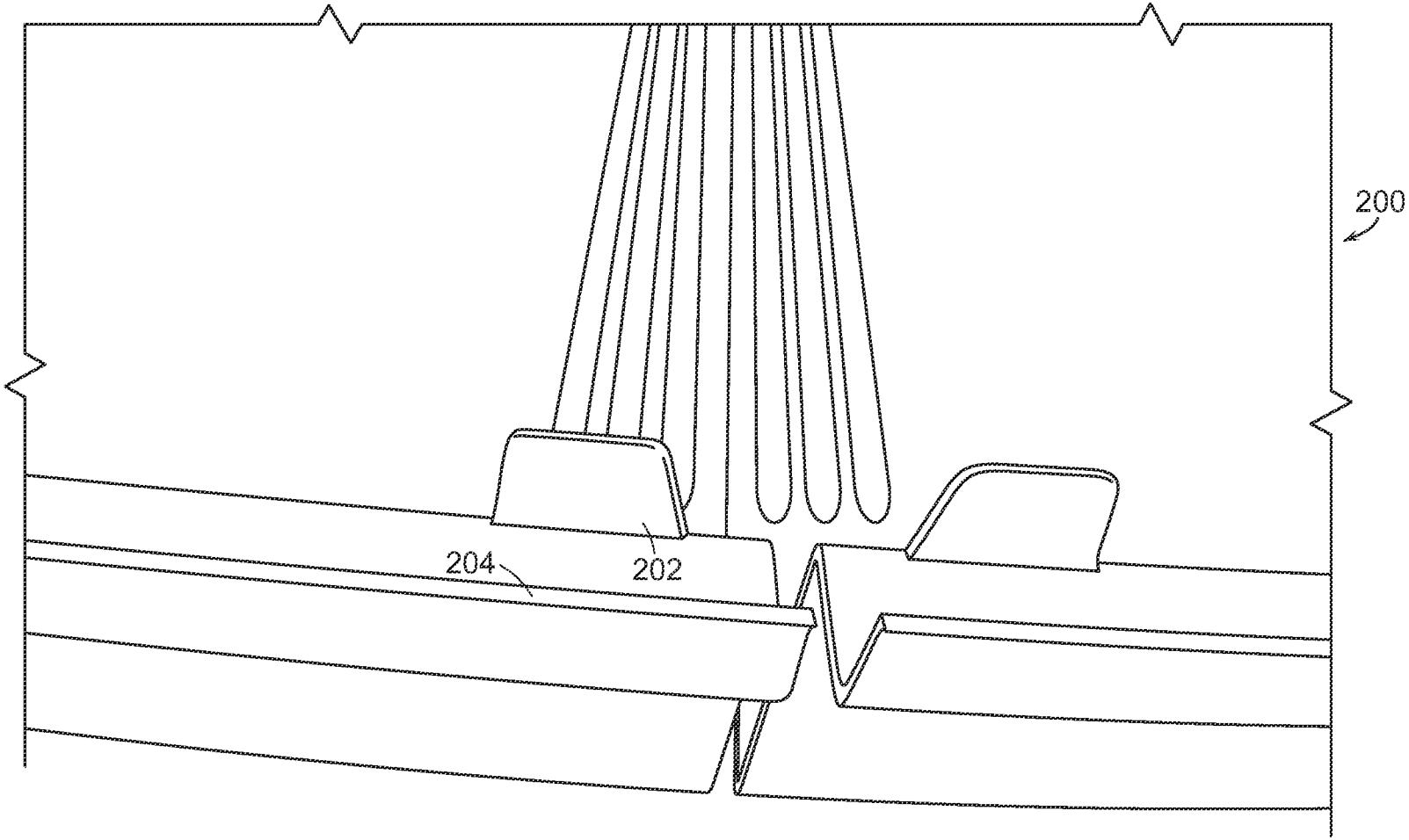
FIG. 10 is another close-up perspective view of the underside of the storage container lid of FIGS. 7-9B.

As shown in FIGS. 9A and 9B, the first portion 221 of the lid 200 may include a first supporting element 202A1 and second supporting element 202A2 on opposite sides of the first portion 221. Similarly, the second portion 222 of the lid 200 may include a first supporting element 202B1 and second supporting element 202B2 on opposite sides of the second portion 222. Accordingly, when the lid shown in FIG. 1A includes the supporting element 202, the coupling region R shown in FIG. 1A can be reinforced by the supporting elements 202. In some embodiments, the arraignment of supporting elements 202 may permit a gap 231 to be present between first and second portions 221, 222 to prevent the movable portion (either portion 221 or 222) from direct contact with the base portion when opening and closing the lid 200 (as shown in FIGS. 1A and 1B). In some embodiments, the gap 231 provide functions similar to gap 123 described with reference to FIGS. 4A and 4B.

In some embodiments, the supporting element(s) 202 apply a force to the container body 102 so that the lid 200 is securely mated with the container body 102. For example, a rim 112 of the container body 102 can be inserted in the channel 244 formed by the supporting element(s) 202 and wall of the lid (described above). The channel 244 may have a width that is less than the rim 112 inserted into the channel 244 such as that a pressure or force is applied by the supporting element 202 and wall 243 in a direction of the rim 112 in the channel 244. Another feature of the supporting elements 202 is that they can provide stability with respect to the force(s) applied to the container body 102. In doing do, the supporting elements 202 can reduce undesirable forces that may be applied to the hinge unit 278 such as tensile forces, compressive forces, shear forces, bending, torsion, and/or other stresses during use. As described above, the hinge unit 278 may a smaller thickness than the container body portions 221, 222 intersecting at the hinge unit 278 so that one portion 221, 222 can rotate about a bend axis formed by the hinge unit 278 relative to the other portion 221, 222. However, the smaller thickness of the hinge unit 278 may be prone to tearing or other separation due to undesirable forces applied to one or both container portions 221, 222. When the lid 200 is coupled to the container body 102, the rim or other peripheral region of the container body 102 is inserted into the channel 244 formed by the the supporting element(s) 202 and wall of the lid (described above) which can prevent shear forces or the like to be applied to the hinge unit 278 during operation, and allows the hinge assembly to bend about a bend axis along which the hinge unit 278 extends, and thereby permits one container body portion 221, 222 to open and close relative to the other body portion 221, 222, which is in a stationary position relative to the container body 102.

While the present inventive concepts have been particularly shown and described above with reference to exemplary embodiments thereof, it will be understood by those of ordinary skill in the art, that various changes in form and detail can be made without departing from the spirit and scope of the present inventive concepts.

What is claimed is:

1. A plastic container, comprising:

a container body having an opening to an interior of the container body; and a lid constructed and arranged for removably coupling to the container body, the lid comprising:

a base portion covering a first region of the opening of the container body;

a movable portion covering a second region of the opening of the container body in a closed position and exposing the opening to the interior of the container body in an open position; and a hinge arrangement between the base portion and the movable portion, wherein the movable portion is constructed and arranged to rotate about an axis along which the hinge arrangement extends so that the movable portion in the closed position extends along a same longitudinal line as the base portion; and in an open position rotates about the hinge arrangement to be at an acute angle relative to the base portion, wherein the base portion and the movable portion each extends at a predetermined height above the opening of the container body to increase a volume of an interior of the container to be greater than the interior of the container body, wherein the hinge arrangement comprises:

a first plurality of ridges;

a second plurality of ridges parallel to the first plurality of ridges, the first and second plurality of ridges being supporting ribs extending along a width of the lid and allow for the movable portion to rotate about the hinge arrangement to be at an acute angle relative to the base portion;

a hinge unit parallel to the first and second plurality of ridges that connects the first plurality of ridges and the second plurality of ridges; and a gap between an outer edge of the base portion and an outer edge of the movable portion in the closed position, wherein the gap begins at a distal end of the hinge unit and extends parallel to the first and second plurality of ridges to an outermost edge of the lid.

2. The plastic container of claim 1, wherein the base portion, movable portion, and hinge arrangement are unitary and molded from a common source of plastic.

3. The plastic container of claim 2, wherein the hinge unit extends along the width of the lid and is longer than the first and second plurality of ridges and has a thickness that it is less than that of the base portion and the movable portion.

4. The plastic container of claim 1, further comprising at least one supporting element that extends from the base portion to apply a force to a periphery of the container body.

5. A plastic lid constructed and arranged for removably coupling to a container body, the plastic lid comprising:

a base portion covering a first region of the opening of the container body;

a movable portion covering a second region of the opening of the container body in a closed position and exposing the opening to the interior of the container body in an open position; and a perimeter skirt constructed and arranged to form a seal with a rim of the container body, wherein the base portion and the movable portion each extends at a predetermined height above the opening of the container body to increase a volume of an interior of the container to be greater than the interior of the container body; and a hinge arrangement between the base portion and the movable portion, wherein the movable portion is constructed and arranged to rotate about an axis along which the hinge arrangement extends so that the movable portion in the in closed position extends along a same longitudinal line as the base portion; and in an open position rotates about the hinge arrangement to be at an acute angle relative to the base portion, wherein the base portion and the movable portion each extends at a predetermined height above the opening of the container body to increase a volume of an interior of the container to be greater than the interior of the container body, wherein the hinge arrangement comprises:

a first plurality of ridges;

a second plurality of ridges parallel to the first plurality of ridges, the first and second plurality of ridges being supporting ribs extending along a width of the lid and allow for the movable portion to rotate about the hinge arrangement to be at an acute angle relative to the base portion;

a hinge unit parallel to the first and second plurality of ridges that connects the first plurality of ridges and the second plurality of ridges; and a gap between an outer edge of the base portion and an outer edge of the movable portion in the closed position, wherein the gap begins at a distal end of the hinge unit and extends parallel to the first and second plurality of ridges to an outermost edge of the lid.

6. The plastic container of claim 1, wherein the hinge unit has a thickness that is less than a thickness of the first plurality of ridges and the second plurality of ridges.

7. The plastic container of claim 1, wherein the first plurality of ridges extends from the base portion and the second plurality of ridges extend from the movable portion, wherein the first plurality of ridges are stationary and the second plurality of ridges pivotably rotate relative to the stationary first plurality of ridges and about the axis along which the hinge unit extends.

8. The plastic container of claim 1, further comprising a first locking clip coupled to an annular flange of the container body for engaging with a front region of the movable portion opposite the rear portion to which the hinge arrangement is coupled.

9. The plastic container of claim 8, further comprising a second locking clip coupled to the annular flange of the container body for engaging with the base portion, wherein the first locking clip and the second locking clip are constructed and arranged as handles.

10. The plastic container of claim 1, further comprising a pair of stabilizing bars extending from an underside of the first plurality of ridges and the second plurality of ridges, respectively.

11. The plastic container of claim 10, further comprising a pair of tabs that extend vertically between the pair of stabilizing bars to contribute to a reinforcement of the hinge unit.

12. The plastic container of claim 10, wherein the lid includes one or more supporting elements that extend in a vertical or orthogonal direction from a perimeter of the container body to prevent shear forces from being applied to the hinge unit.

* * * * *